US008177328B2

(12) United States Patent
Yoshikawa et al.

(10) Patent No.: US 8,177,328 B2
(45) Date of Patent: May 15, 2012

(54) INK JET PRINTING APPARATUS AND INK JET PRINTING METHOD

(75) Inventors: Hirokazu Yoshikawa, Yokohama (JP); Hidehiko Kanda, Yokohama (JP); Norihiro Kawatoko, Yokohama (JP); Toshiyuki Chikuma, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 660 days.

(21) Appl. No.: 12/234,843

(22) Filed: Sep. 22, 2008

(65) Prior Publication Data

US 2009/0102875 A1 Apr. 23, 2009

(30) Foreign Application Priority Data

Sep. 27, 2007 (JP) ..... 2007-251537

(51) Int. Cl.
*B41J 2/145* (2006.01)

(52) U.S. Cl. ..... 347/40; 347/41; 358/3.06

(58) Field of Classification Search ..... 347/5, 9, 347/41, 42, 43, 15, 40; 358/3.06
See application file for complete search history.

(56) References Cited

U.S. PATENT DOCUMENTS

| | | | | |
|---|---|---|---|---|
| 6,682,168 | B2 * | 1/2004 | Nakagawa et al. | 347/40 |
| 6,755,496 | B2 | 6/2004 | Nishikori et al. | |
| 6,832,825 | B1 | 12/2004 | Nishikori et al. | |
| 2006/0007494 | A1 * | 1/2006 | Fujimori | 358/3.06 |
| 2007/0019031 | A1 * | 1/2007 | Murayama et al. | 347/43 |

FOREIGN PATENT DOCUMENTS

| | | | |
|---|---|---|---|
| JP | 08-58083 | A | 3/1996 |
| JP | 2006-168374 | A | 6/2006 |

* cited by examiner

*Primary Examiner* — Lam S Nguyen

(74) *Attorney, Agent, or Firm* — Fitzpatrick, Cella, Harper & Scinto

(57) ABSTRACT

Provided are an ink jet printing apparatus and an ink jet printing method which are capable of printing high-quality images by performing printing scanning in a forward direction and in an opposite direction without needing complicated control of a transfer amount of a printing medium nor causing throughput degradation. Inks are ejected from odd-numbered nozzles in scanning in the forward direction and are ejected from even-numbered nozzles in scanning in the opposite direction.

8 Claims, 7 Drawing Sheets

INK JET PRINTING APPARATUS AND INK JET PRINTING METHOD

BACKGROUND OF THE INVENTION

1. Field of the Invention

The present invention relates to an ink jet printing apparatus and an ink jet printing method for printing an image with reciprocating scanning of a printing head capable of ejecting ink.

2. Description of the Related Art

In recent years, an ink jet printing apparatus which performs printing by ejecting ink onto a printing medium from nozzles of a printing head has been widely used as an apparatus for outputting an image created by a computer or an image taken by an image pickup device such as a digital camera. This ink jet printing apparatus can form a high-quality image comparable to a silver halide photograph by use of a small and inexpensive configuration. Currently, there is also available a printing apparatus capable of printing an image on an entire surface of a printing medium without leaving any margin at the ends of the printing medium as in the case of the silver halide photograph.

To improve a printing speed, such an ink jet printing apparatus employs a printing head having a plurality of ink ejection ports and liquid passages integrated therein, as a printing head (hereinafter also referred to as a "multi-head") having a plurality of printing elements integrated and arranged therein. Furthermore, an ink jet printing apparatus capable of printing a color image generally uses a plurality of such multi-heads.

A so-called serial scan type ink jet printing apparatus prints images sequentially on a printing medium by repeating printing scanning of such a printing head in a main scanning direction and transfer movement of the printing medium in a sub-scanning direction intersecting the main scanning direction. The printing head is usually mounted on a carriage capable of reciprocating movement along the main scanning direction, and ejects ink while moving in the main scanning direction together with the carriage during the printing scanning. There are two types of methods for printing images: one is a one-way printing method for performing printing scanning in movement of the printing head only in one direction, and the other is a two-way printing method for performing printing scanning in movement of the printing head in one direction and in the other direction.

An ink droplet to be ejected from the ink ejection port of the printing head include a main droplet and a small droplet separated out of the main droplet. The main droplet and the small droplet form large dot and small dot, respectively, when landing on the printing medium. The small dot is also called a "satellite". The small droplet forming the satellite is ejected simultaneously with the main droplet. Specifically, during ink ejection, a main droplet has a tail portion caused at its rear side by a tension between the main droplet and a liquid level of an ink meniscus in the ink ejection port. Then, the tail portion is separated by a surface tension so as to form a spherical shape. Thus, the small droplet is formed. As described above, the surface tension acting when the small droplet is separated from the ink meniscus in the ink ejection port pulls the small droplet backwardly in an ejection direction. Thus, an ejection speed of the small droplet is slower than that of the main droplet.

Moreover, in the case where a printing surface of the printing medium is parallel to an opening surface (ejection port forming surface) in which the ink ejection ports are formed, a relationship between landing positions of the main droplet and the small droplet, which are different from each other in the ejection speed, is constant as long as the opening surface is even. Thus, except for the case of a significant temperature increase or the like, quality of printed images is unlikely to be changed even in the two-way printing method.

However, when the ink ejection ports are formed to be tilted with respect to the opening surface, the opening surface around the ink ejection port may have a partially-varying affinity for ink, so that the ejection direction of the small droplet is changed.

FIGS. 6A and 6B are explanatory views showing different formation examples of ink ejection port arrays (hereinafter also referred to as "nozzle arrays") in printing heads H. In FIGS. 6A and 6B, No denotes odd-numbered (N1, N3, . . . ) ink ejection ports (hereinafter also referred to as "odd nozzles") from one end of the nozzle array, and Ne denotes even-numbered (N2, N4, . . . ) ink ejection ports (hereinafter also referred to as "even nozzles") from the one end of the nozzle array. In the printing head H shown in FIG. 6A, the odd nozzles No and the even nozzles Ne are formed at equal intervals on one nozzle array. Meanwhile, in the printing head H shown in FIG. 6B, the odd nozzles No are formed at equal intervals (pitches P) on an odd nozzle array Lo and the even nozzles Ne are formed at equal intervals (pitches P) on an even nozzle array Le. Moreover, those nozzles No and Ne are shifted from each other by a half pitch (P/2).

In the printing head H as described above, when the odd nozzles No are formed to be tilted toward one side in main scanning directions and the even nozzles Ne are formed to be tilted toward the other side in the main scanning directions, a relationship between landing positions of main droplets and small droplets may change depending on scanning directions as described below.

FIGS. 7A and 7B are explanatory views showing landing positions of main droplets and small droplets, which are ejected from the printing head H shown in FIG. 6B. A main droplet and a small droplet, which are ejected from the even nozzle Ne, form a main dot D'1 and a satellite D'2, respectively, on a printing medium P. Moreover, a main droplet and a small droplet, which are ejected from the odd nozzle No, form a main dot D1 and a satellite D2, respectively, on the printing medium P. In the case of this example, the even nozzle Ne is formed to be tilted to a forward direction (first direction) X1 in the main scanning directions, and the odd nozzle No is formed to be tilted to an opposite direction (second direction) X2 in the main scanning directions. Moreover, the tilt of the even nozzle Ne to the forward direction X1 is equal to the tilt of the odd nozzle No relative to the opposite direction X2.

FIG. 7A is the explanatory view showing the case of printing scanning in the forward direction X1, and FIG. 7B is the explanatory view showing the case of printing scanning in the opposite direction X2. In each of FIGS. 7A and 7B, VD1 is an ejection speed of the main droplet that forms the main dot D1, VD'1 is an ejection speed of the main droplet that forms the main dot D'1, VD2 is an ejection speed of the small droplet that forms the satellite D2, and VD'2 is an ejection speed of the small droplet that forms the satellite D'2. The ejection speeds VD2 and VD'2 of the small droplets are slower than the ejection speeds VD1 and VD'1 of the main droplets. Moreover, ejection directions of the small droplets are shifted from those of the main droplets under the influence of ink affinity of the opening surface (ejection port forming surface) H1 of the printing head H.

Since the main droplets D1 and D'1 and the small droplets D2 and D'2 are ejected during movement of the printing head H, a movement speed of a carriage moving together with the printing head H is added to the ejection speeds of the droplets.

Thus, when a movement direction of the carriage is the same as the ejection direction of the ink droplet (the tilt direction of the ejection port), landing positions of the main droplets and the small droplets are shifted from each other so as to form the main dot D'1 and the satellite D'2 in FIG. 7A and the main dot D1 and the satellite D2 in FIG. 7B. Specifically, the landing positions of the small droplets are shifted in the movement direction of the carriage from those of the main droplets. Meanwhile, when the movement direction of the carriage is opposite to the ejection direction of the ink droplet, the main droplets and the small droplets land on approximately the same positions so as to form the main dot D1 and the satellite D2 in FIG. 7A and the main dot D'1 and the satellite D'2 in FIG. 7B.

As described above, the change in the relationship between the landing positions of the main droplets and the small droplets depending on the scanning directions may impair quality of printed images when the two-way printing method is employed.

Japanese Patent Laid-Open No. Hei 8 (1996)-58083 describes a configuration with a printing head having all the ink ejection ports tilted in the same direction, in which a printing scanning speed between printing scanning in a forward direction and that in an opposite direction is changed according to a tilt of ink ejection ports in order to suppress such a change in a relationship between landing positions of main droplets and small droplets. Moreover, Japanese Patent Laid-Open No. 2006-168374 describes a configuration in which printing scanning in the forward direction and that in the opposite direction as shown in FIGS. 7A and 7B are repeated in a multi-pass printing method for printing in a predetermined printing region on a printing medium by scanning more than once. In the case of Japanese Patent Laid-Open No. 2006-168374, a visually good image can be printed, regardless of a change in a relationship between landing positions of main droplets and small droplets, by changing a transfer amount of the printing medium between the printing scanning in the forward direction and that in the opposite direction.

However, the configuration described in Japanese Patent Laid-Open No. Hei 8 (1996)-58083 changes the printing scanning speed between the printing scanning in the forward direction and that in the opposite direction according to the tilt of the ink ejection port (tilt of the ink ejection direction). Thus, throughput degradation may occur. Moreover, the configuration described in Japanese Patent Laid-Open No. 2006-168374 changes the transfer amount of the printing medium between the printing scanning in the forward direction and that in the opposite direction. Thus, transfer control of the printing medium may become complicated.

SUMMARY OF THE INVENTION

The present invention provides an ink jet printing apparatus and an ink jet printing method, which are capable of printing high-quality images by performing printing scanning in a forward direction and in an opposite direction without needing complicated control of a transfer amount of a printing medium nor causing throughput degradation.

In a first aspect of the present invention, there is provided an ink jet printing apparatus which prints an image by causing a printing head to scan a printing medium in a first direction and in a second direction, the printing head having a nozzle array in which a plurality of nozzles capable of ejecting ink are arranged, the plurality of nozzles including an odd-numbered nozzle group of odd-numbered nozzles from one end of the nozzle array and an even-numbered nozzle group of even-numbered nozzles from the one end of the nozzle array, the ink jet printing apparatus comprising: a controller which allows the ink to be ejected from one of the odd-numbered nozzle group and the even-numbered nozzle group in scanning in the first direction and also allows the ink to be ejected from the other one of the odd-numbered nozzle group and the even-numbered nozzle group in scanning in the second direction.

In a second aspect of the present invention, there is provided an ink jet printing method for printing an image by causing a printing head to scan a printing medium in a first direction and in a second direction, the printing head having a nozzle array in which a plurality of nozzles capable of ejecting ink are arranged, the plurality of nozzles including an odd-numbered nozzle group of odd-numbered nozzles from one end of the nozzle array and an even-numbered nozzle group of even-numbered nozzles from the one end of the nozzle array, the ink jet printing method comprising the steps of: ejecting ink from one of the odd-numbered nozzle group and the even-numbered nozzle in scanning in the first direction; and ejecting the ink from the other one of the odd-numbered nozzle group and the even-numbered nozzle group in scanning in the second direction.

According to the present invention, in a so-called multi-pass printing method, high-quality images can be printed without needing complicated control of a transfer amount of the printing medium nor causing throughput degradation by selectively using the odd nozzles and the even nozzles depending on the scanning directions of the printing head.

Further features of the present invention will become apparent from the following description of exemplary embodiments (with reference to the attached drawings).

DESCRIPTION OF THE EMBODIMENTS

With reference to the drawings, embodiments of the present invention will be described below.

(First Embodiment)

Figure 1:
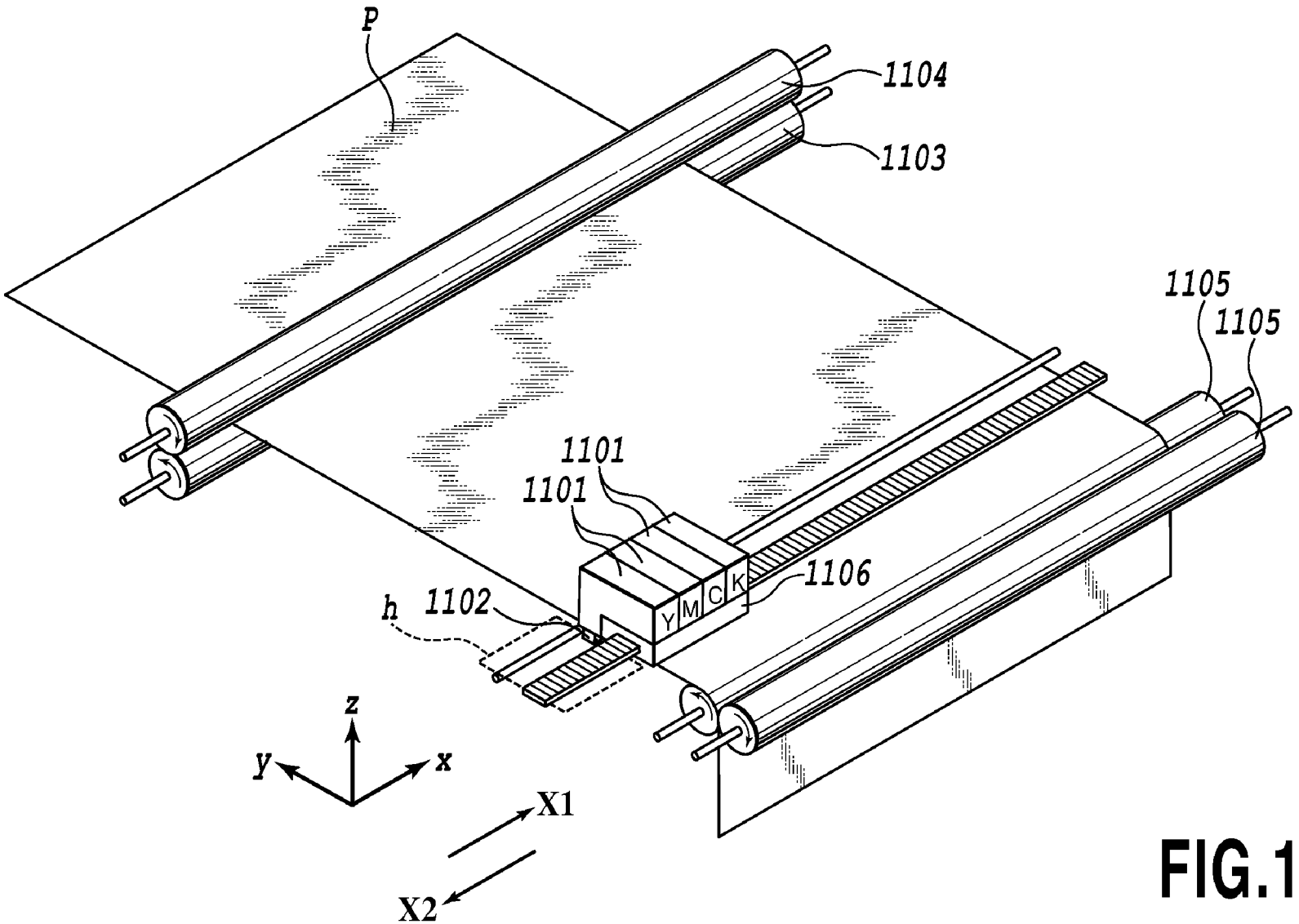
FIG. 1 is a perspective view of a main part of an ink jet printing apparatus to which the present invention can be applied.

FIG. 1 is a perspective view of a main part of an ink jet printing head to which the present invention can be implemented.

Reference numerals 1101 denote four ink jet cartridges, which are formed of ink tanks containing color inks of four colors, including black, cyan, magenta and yellow, and a printing head (multi-head) 1102 compatible with those inks.

Figure 2:
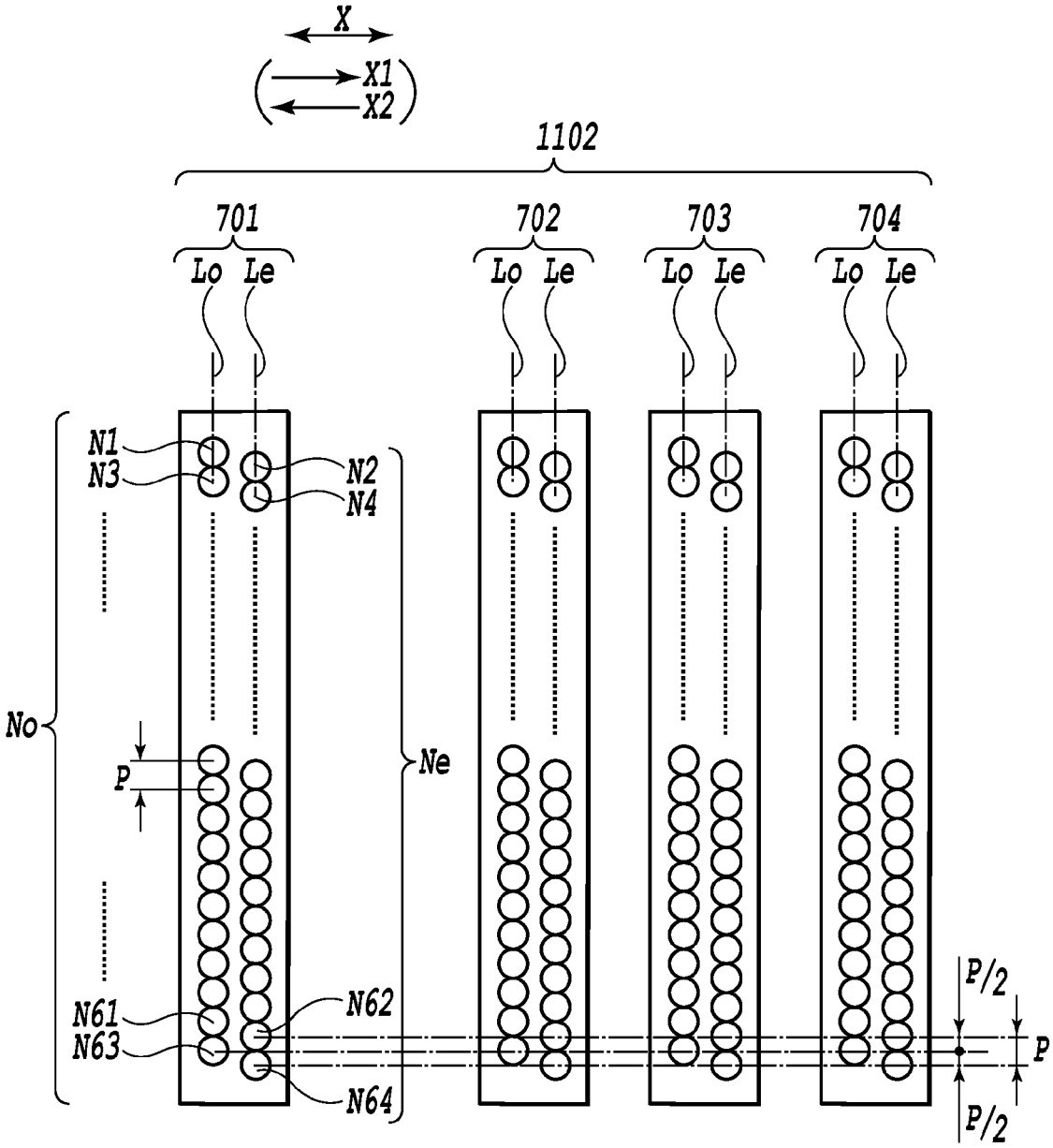
FIG. 2 is a schematic view for explaining a nozzle configuration in a printing head used in the ink jet printing apparatus shown in FIG. 1.

As shown in FIG. 2, the printing head 1102 includes a printing head 701 for black ink, a printing head 702 for cyan ink, a printing head 703 for magenta ink and a printing head 704 for yellow ink. In these printing heads, nozzles are formed of ink ejection ports, ink passages communicated therewith, ejection energy generating elements to be described later, which are included in the ink passages, and the like.

In FIG. 2, No denotes odd-numbered (N1, N3, . . . ) ink ejection ports (hereinafter also referred to as "odd nozzles") and Ne denotes even-numbered (N2, N4, . . . ) ink ejection ports (hereinafter also referred to as "even nozzles"). Specifically, the nozzles having odd numbers assigned thereto among consecutive numbers given along a nozzle arrangement direction are the odd nozzles, and the nozzles having even numbers assigned thereto among the consecutive numbers are the even nozzles.

Figure 6A:
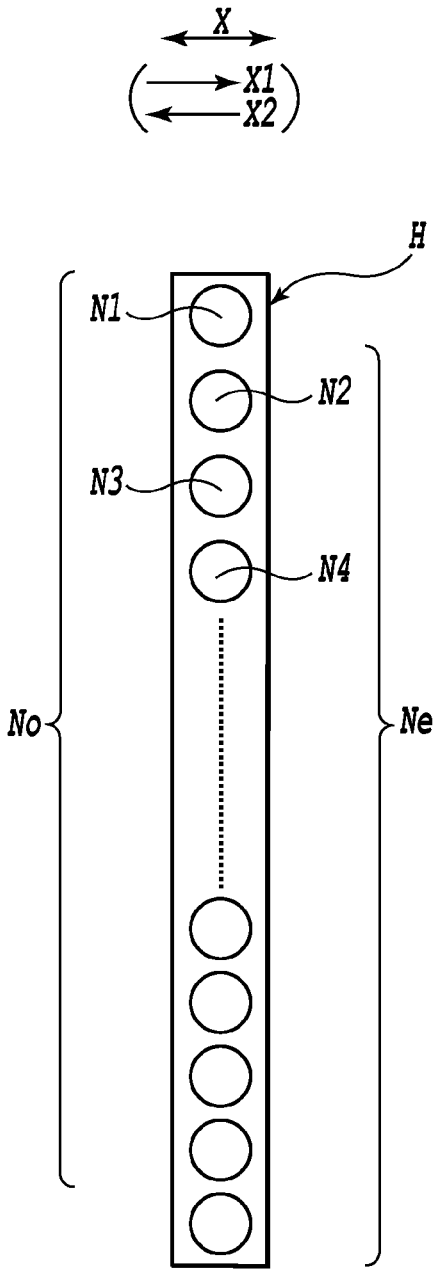
FIGS. 6A and 6B are schematic views for explaining different nozzle configurations of printing heads.
Figure 6B:
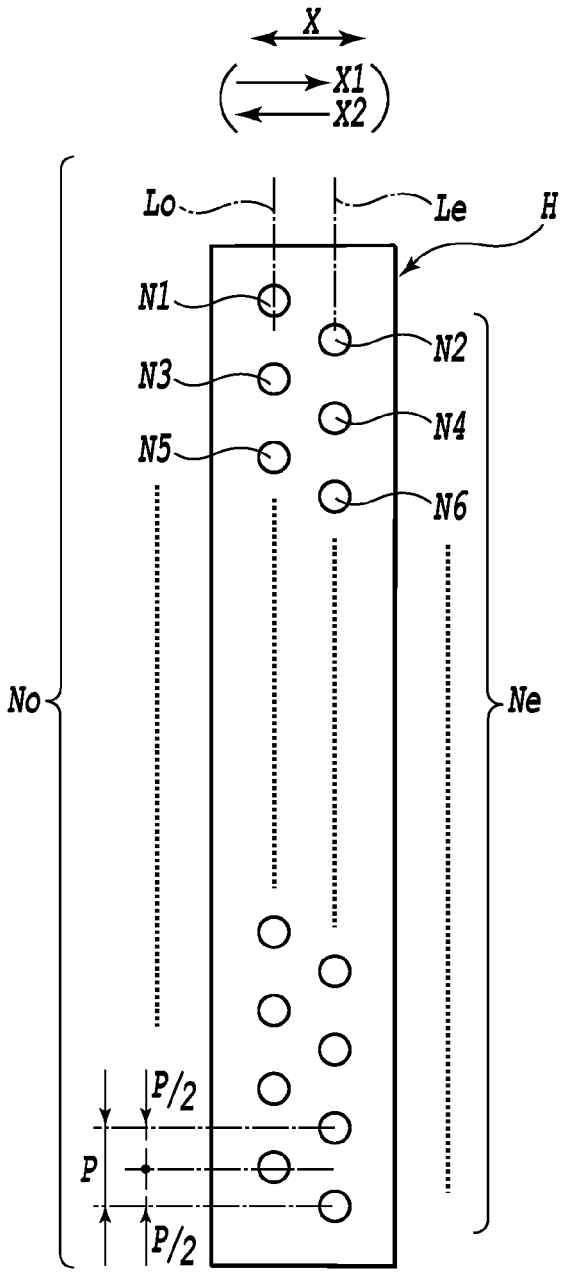

In the printing head of this example, as in the case of FIG. 6B described above, the odd nozzles No and the even nozzles Ne are formed. Specifically, the odd nozzles No are formed at equal intervals (pitches P) on odd nozzle arrays Lo and the even nozzles Ne are formed at equal intervals (pitches P) on even nozzle arrays Le. Moreover, those nozzles No and Ne are shifted from each other by a half pitch (P/2). To be more specific, the odd nozzles No and the even nozzles Ne are arranged alternately at the same pitches along the nozzle arrangement direction and are also arranged separately on the odd nozzle arrays and on the even nozzle arrays. In each of the nozzle arrays Lo and Le, d nozzles are formed. A length of the printing head is set to d/D. The printing head may have another configuration, for example, the configuration as shown in FIG. 6A.

In the case of this example, the nozzles No and Ne in each of the printing heads are arranged at a density of D=300 per inch (300 dpi), respectively. A nozzle interval (nozzle pitch) P is P=1/D=1/300 inch≈84.7 μm. Moreover, the number d of the nozzles formed in each of the nozzle arrays Lo and Le is 32 (32 nozzles), and the length d/D of the printing head is 32/300 inches (≈2.71 mm). A shift amount P/2 between the nozzles No and Ne in a sub-scanning direction is 1/600 inch. Therefore, in each of the printing heads, 64 nozzles are actually formed at a density of 600 per inch (600 dpi). The printing heads 701 to 704 have the same configuration and are arranged in a main scanning direction as shown in FIG. 2.

In FIG. 1, reference numeral 1103 denotes a paper feed roller, which is rotated in an arrow direction together with an auxiliary roller 1104 while sandwiching a printing medium P therebetween to transfer the printing medium P in the sub-scanning direction indicated by an arrow y. Reference numerals 1105 denote a pair of paper feed rollers which feed the printing medium P. The pair of rollers 1105 are rotated while sandwiching the printing medium P therebetween as in the case of the rollers 1103 and 1104. A rotation speed of the rollers 1105 is set slower than that of the paper feed roller 1103. Thus, tension can be applied to the printing medium P. Reference numeral 1106 denotes a carriage which has the four inkjet cartridges 1101 mounted thereon and moves back and forth in the main scanning direction indicated by an arrow x. The main scanning direction and the sub-scanning direction intersect (in the case of this example, are orthogonal to) each other. The carriage 1106 stands by at a home position h indicated by a broken line in FIG. 1 when no printing is performed or recovery processing for the multi-head 1102 and the like are performed.

The carriage 1106 at the home position h before start of printing is moved in the main scanning direction together with the ink jet cartridges 1101 in response to a printing start command. Thus, the inks are ejected from the nozzles of the printing head. By repeating such printing scanning and transfer movement of the printing medium P in the sub-scanning direction, images are printed sequentially on the printing medium P.

In the case of a 1-pass printing mode for printing an image in a predetermined region by one time of scanning, printing is performed for a width of d/D inches by the d nozzles arranged at the density of D per inch for each time of printing scanning. During such printing scanning, the paper feed roller 1103 is rotated in the arrow direction to transfer the printing medium P in the sub-scanning direction for d/D inches. As described above, in the 1-pass printing mode, the printing for the width of d/D inches (printing for a width of 1 inch of the printing medium by use of D nozzles) for each time of main scanning and the transfer (paper feed) of the printing medium P for d/D inches are repeated. Thus, for example, printing for 1 page on the printing medium P can be completed.

In the case of a 2-pass printing mode for printing an image in a predetermined region by two times of scanning, printing is performed for a width of d/D inches by the d nozzles arranged at the density of D per inch for each time of printing scanning. In this event, dots are formed based on printing data thinned out to about half according to a predetermined pattern. In a subsequent transfer operation, the paper feed roller 1103 is rotated in the arrow direction to transfer the printing medium P in the sub-scanning direction for d/2D inches. As described above, in the 2-pass printing mode, the printing for the width of d/D inches (printing for a width of 1 inch of the printing medium by use of D nozzles) for each time of main scanning and the transfer (paper feed) of the printing medium P for d/2D inches are repeated.

In the case of an M-pass printing mode for printing an image in a predetermined region by M (≧2) times of scanning, printing data is thinned out to 1/M and a transfer amount of the printing medium P is set to d/MD inches. Such M-pass printing modes are also collectively called a multi-pass printing mode. Such a multi-pass printing mode is most suitable for printing high-quality color photograph images.

Moreover, there are two types of printing methods: one is a one-way printing method for performing printing scanning only in movement of the printing head in one direction, and the other is a two-way printing method for performing printing scanning in movement of the printing head in one direction and in the other direction.

Figure 3:
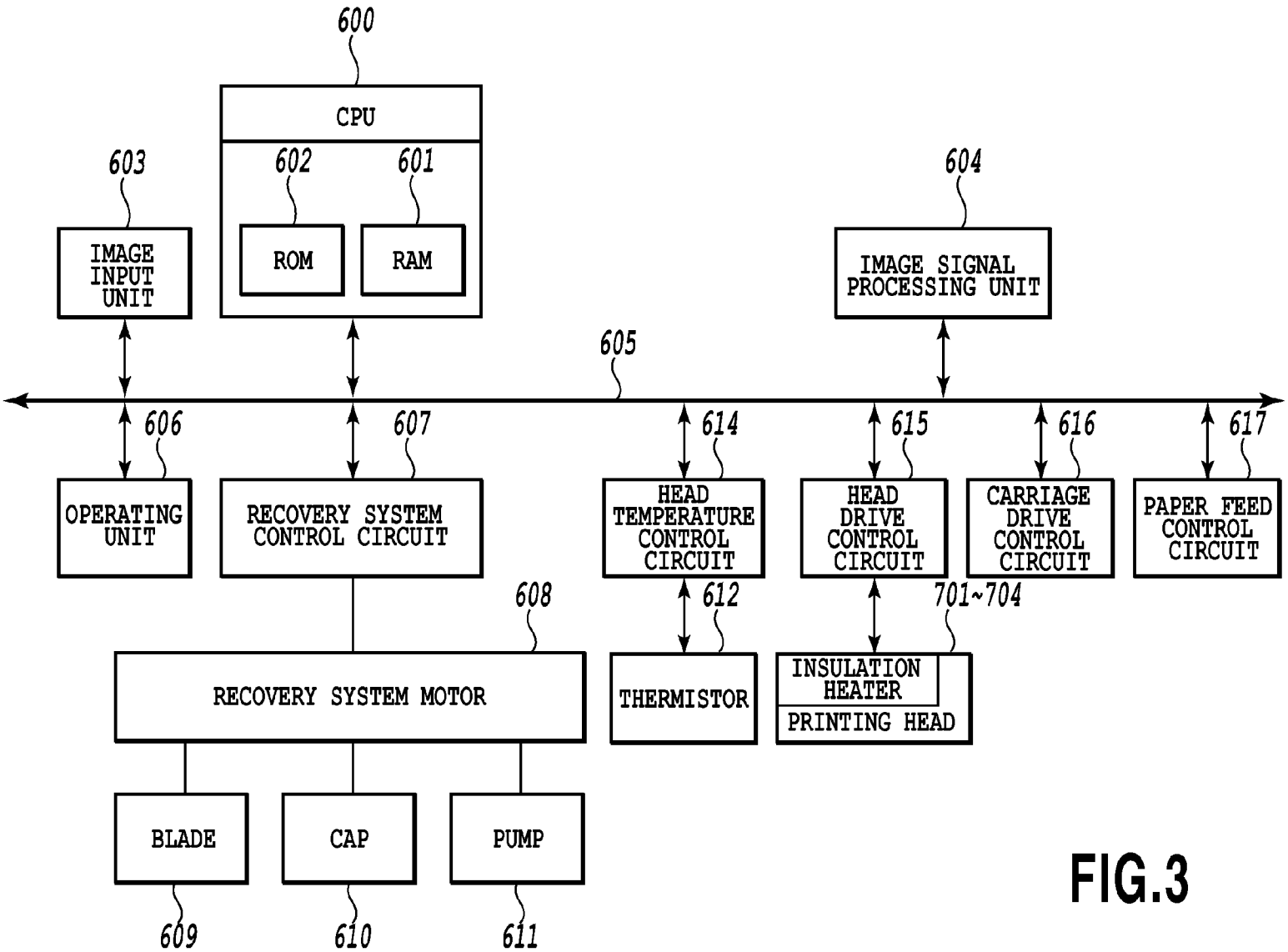
FIG. 3 is a block configuration diagram of a control system in the ink jet printing apparatus shown in FIG. 1.

FIG. 3 is a block configuration diagram of a control system in the printing apparatus shown in FIG. 1.

A CPU (controller) 600 executes control of respective parts and data processing through a main bus line 605. Specifically, the CPU 600 executes head drive control, carriage drive control and data processing, which will be described later, according to programs stored in a ROM 601. A RAM 602 is used as a work area for the data processing and the like. As the memory, a hard disk and the like can be used besides those described above.

An image input part 603 has an interface with a host device (not shown) and temporarily holds image data inputted from the host device. An image signal processing part 604 executes data processing as well as color conversion, binarization and the like. An operating part 606 includes keys and the like and allows an operator to make a control input and the like. A recovery system control circuit 607 controls a recovery operation, such as preliminary ejection, according to a recovery processing program stored in the RAM 602. Specifically, a cleaning blade 609 and a cap 610, which can be moved in a direction facing the printing heads 701 to 704, and a suction pump 611 are driven by a recovery system motor 608.

A head drive control circuit 615 allows the inks to be ejected from the ink ejection ports of the printing heads 701 to 704 for printing and preliminary ejection. For example, in the case where the inks are ejected by use of ejection energy generating elements such as electrothermal converters (heaters) and piezoelectric elements, those ejection energy generating elements are driven and controlled. In this example, the electrothermal converters are used. The inks are expanded by heat generated by the electrothermal converters and thus the inks can be ejected from the ink ejection ports by using expansion energy. A carriage drive control circuit 616 and a paper feed control circuit 617, according to the program, similarly control movement of the carriage 1106 and transfer (paper feed) of the printing medium P, respectively.

In a substrate of each of the printing heads in which the electrothermal converters for ink ejection are provided, an insulation heater is provided, which can regulate an ink temperature inside the printing head to a desired temperature. A thermistor 612 is similarly provided in the substrate of the printing head and measures an actual ink temperature inside the printing head. The insulation heater and the thermistor 612 may be provided outside the printing head, for example, around the printing head.

In the case of this example, a motor for driving the paper feed roller to transfer the printing medium P is a pulse motor, of which resolution for 1 pulse is 600 dots per inch (600 dpi) in terms of the transfer amount. Assuming the case where an image having a resolution of 600 dpi in the sub-scanning direction is printed in the 1-pass printing mode by use of the nozzle arrays (about 2.71 mm) in the printing head 701 for black ink, the printing medium P may be transferred in the sub-scanning direction for a printing width of 2.71 mm.

The nozzles in the printing head may be arranged at the density of D per inch (D dpi), in other words, at the nozzle pitch P (P=1/D). Therefore, the resolution for 1 pulse of the pulse motor for driving the paper feed roller to transfer the printing medium P may be D dots per inch (D dpi) in terms of the transfer amount or a multiple thereof.

Figure 4A:
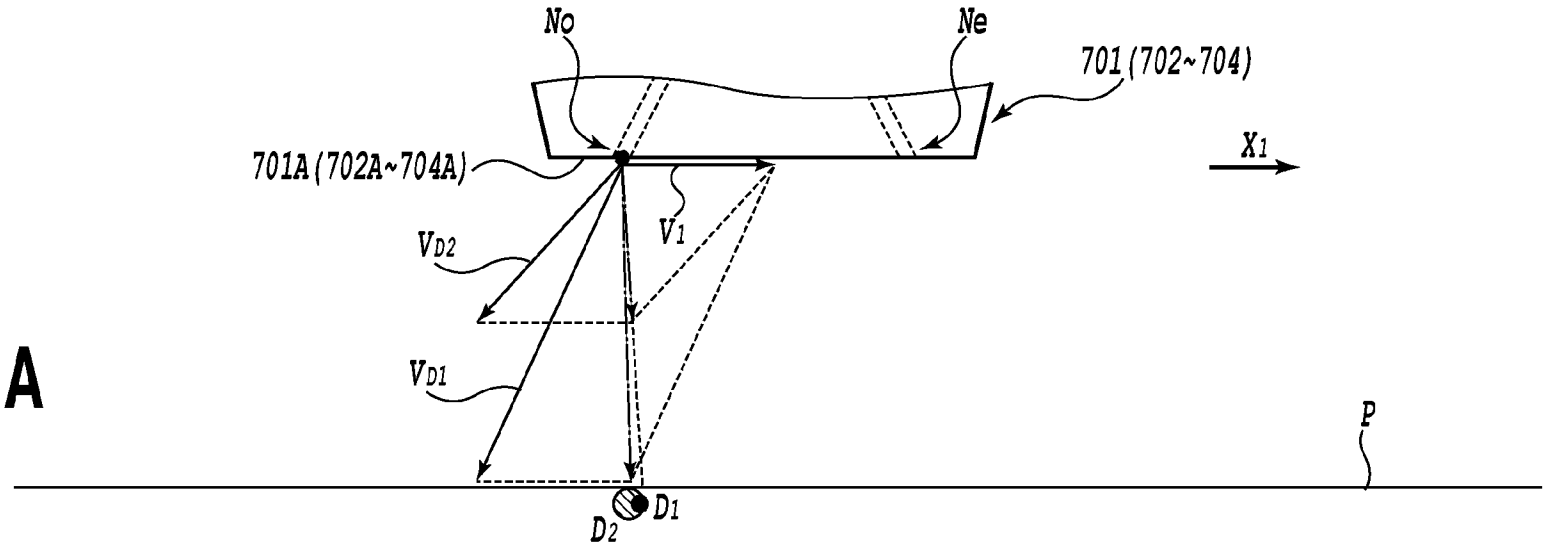
FIG. 4A is an explanatory view showing a positional relationship between a main dot and a satellite, which are formed in printing scanning in a forward direction in a first embodiment of the present invention
Figure 4B:
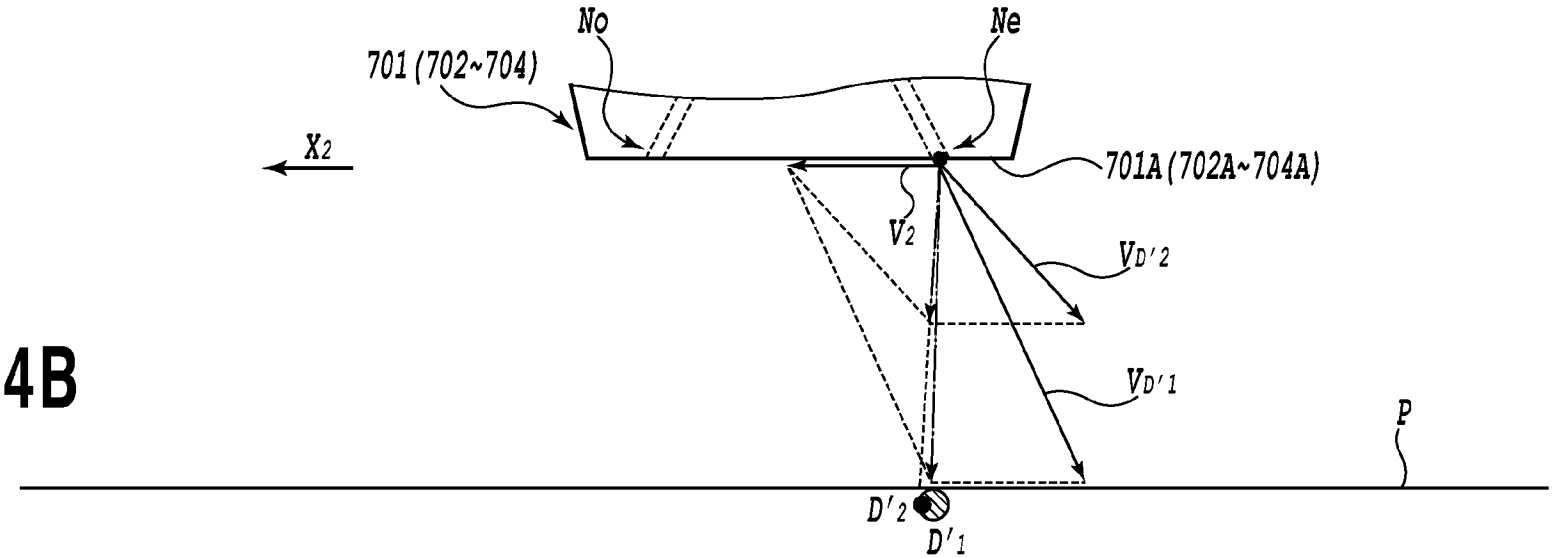
FIG. 4B is an explanatory view showing a positional relationship between a main dot and a satellite, which are formed in printing scanning in an opposite direction in the first embodiment of the present invention.

FIGS. 4A and 4B are views for explaining a method for printing an image according to this embodiment.

A main droplet and a small droplet, which are ejected from the even nozzle Ne, form a main dot D'1 and a satellite D'2, respectively, on the printing medium P. Moreover, a main droplet and a small droplet, which are ejected from the odd nozzle No, form a main dot D1 and a satellite D2, respectively, on the printing medium P. In the case of this example, the even nozzle Ne is formed so as to be tilted toward a forward direction X1 in the main scanning directions, and the odd nozzle No is formed so as to be tilted toward an opposite direction X2 in the main scanning directions. Moreover, the tilt of the even nozzle Ne relative to the forward direction X1 is equal to the tilt of the odd nozzle No relative to the opposite direction X2.

FIG. 4A is an explanatory view showing the case of printing scanning in the forward direction X1, and FIG. 4B is an explanatory view showing the case of printing scanning in the opposite direction X2. In FIGS. 4A and 4B, VD1 is an ejection speed of the main droplet that forms the main dot D1, VD'1 is an ejection speed of the main droplet that forms the main dot D'1, VD2 is an ejection speed of the small droplet that forms the satellite D2, and VD'2 is an ejection speed of the small droplet that forms the satellite D'2. The ejection speeds VD2 and VD'2 of the small droplets are slower than the ejection speeds VD1 and VD'1 of the main droplets. Moreover, ejection directions of the small droplets are shifted from those of the main droplets under the influence of ink affinity of an opening surface (ejection port forming surface) 701A (702A to 704A) of the printing head 701 (702 to 704).

Figure 7A:
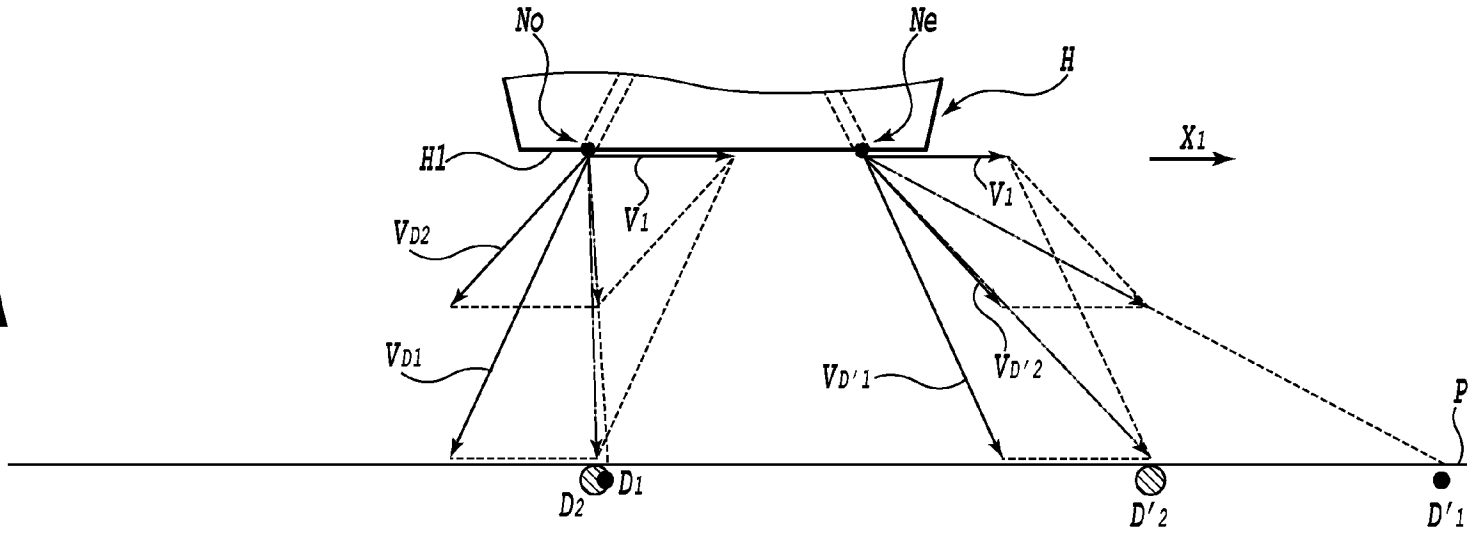
FIG. 7A is an explanatory view showing a positional relationship between a main dot and a satellite, which are formed in printing scanning in a forward direction in a conventional example

In the case of the printing scanning in the forward direction X1 as shown in FIG. 4A, both of the odd nozzle No and the even nozzle Ne are used in the conventional example as shown in FIG. 7A. However, in this embodiment, only the odd nozzle No is used without using the even nozzle Ne as shown in FIG. 4A. Specifically, the printing scanning is performed in the forward direction X1 by using only the odd nozzle No having a small distance between the main dot and the satellite without using the even nozzle Ne having a large distance between the main dot and the satellite.

Figure 7B:
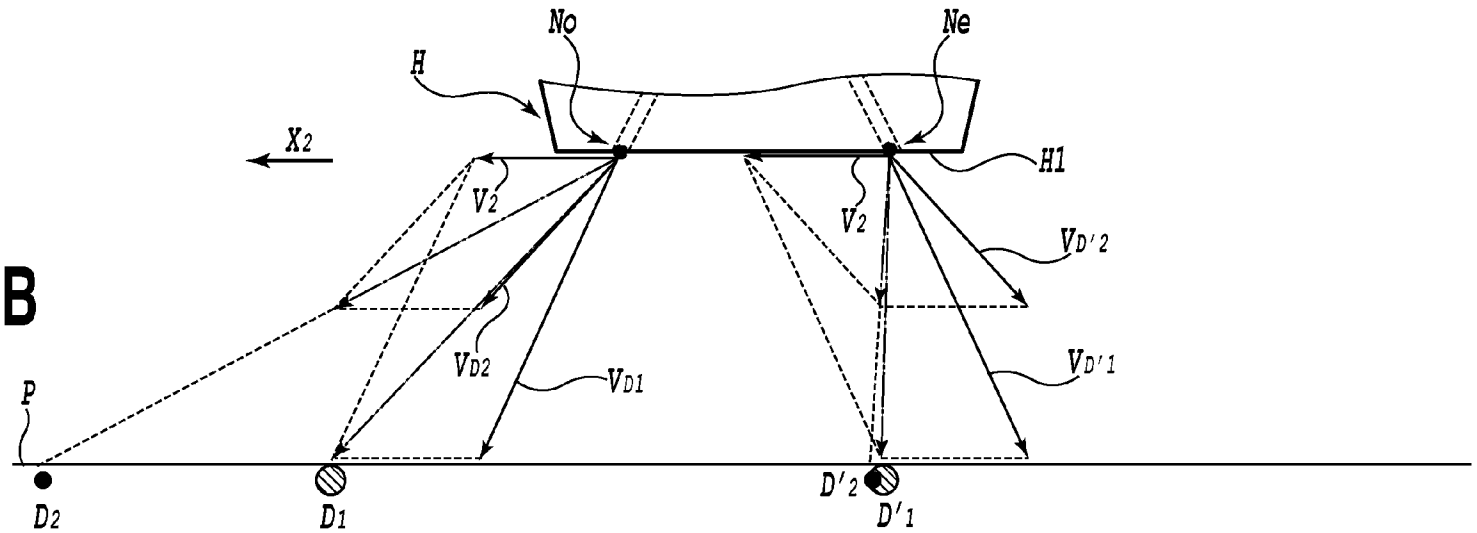
FIG. 7B is an explanatory view showing a positional relationship between a main dot and a satellite, which are formed in printing scanning in an opposite direction in the conventional example.

On the other hand, in the case of the printing scanning in the opposite direction X2 as shown in FIG. 4B, both of the odd nozzle No and the even nozzle Ne are used in the conventional example as shown in FIG. 7B. However, in this embodiment, only the even nozzle Ne is used without using the odd nozzle No as shown in FIG. 4B. Specifically, the printing scanning is performed in the opposite direction X2 by using only the even nozzle Ne having a small distance between the main dot and the satellite without using the odd nozzle No having a large distance between the main dot and the satellite.

As described above, the odd nozzle No is used in the case of the printing scanning in the forward direction X1, and the even nozzle Ne is used in the case of the printing scanning in the opposite direction X2. Thus, in the printing scanning both in the forward direction X1 and in the opposite direction X2, the main droplets and the small droplets can be allowed to land on approximately the same positions. Furthermore, a positional relationship between the main dot and the satellite can be made consistent. Thus, a good image can be printed.

Note that, in the above example, the even nozzle Ne is formed so as to be tilted toward the forward direction X1 and the odd nozzle No is formed so as to be tilted toward the opposite direction X2. However, the present invention is not necessarily limited to such a configuration of the printing head. For example, the present invention can also be applied to the case of use of a printing head in which an even nozzle Ne and an odd nozzle No are formed approximately parallel to one another and are not tilted toward the scanning direction. In this case, in normal printing as well as even when the even nozzle Ne is accidentally tilted toward the forward direction X1 and the odd nozzle No is accidentally tilted toward the opposite direction X2, main droplets and small droplets are allowed to land on approximately the same positions. Thus, a good image can be printed.

(Second Embodiment)

The same printing apparatus and head cartridge as those in the first embodiment described above are used also in this embodiment.

Figure 5A:
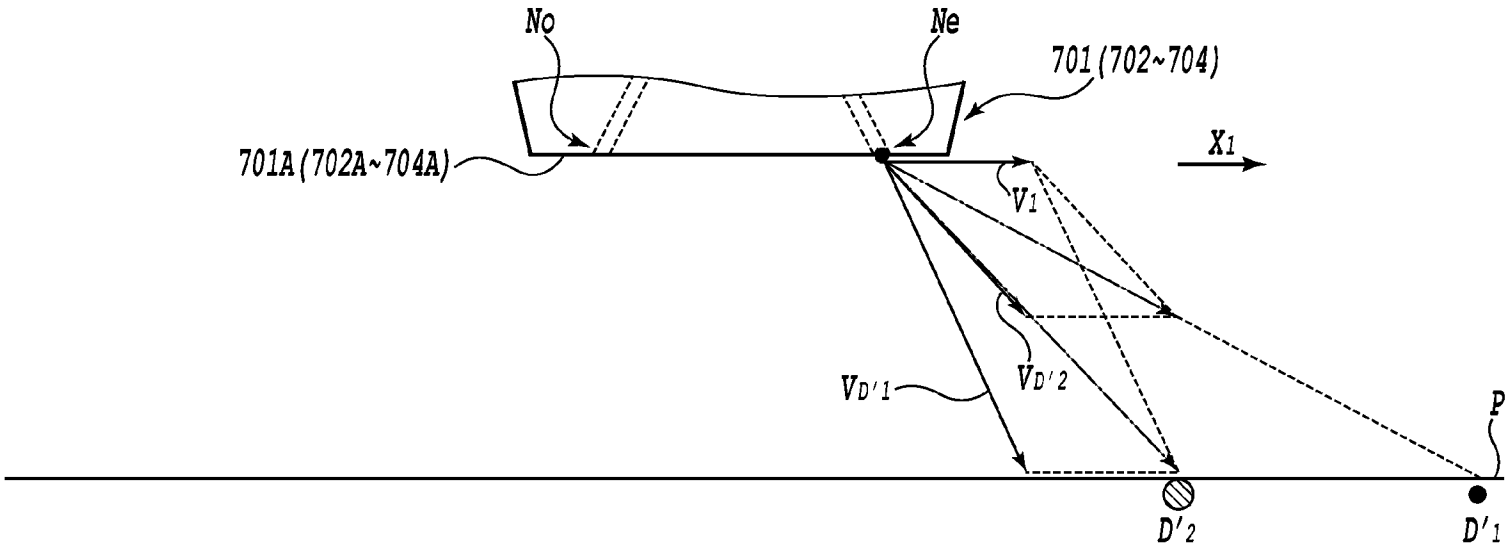
FIG. 5A is an explanatory view showing a positional relationship between a main dot and a satellite, which are formed in printing scanning in a forward direction in a second embodiment of the present invention
Figure 5B:
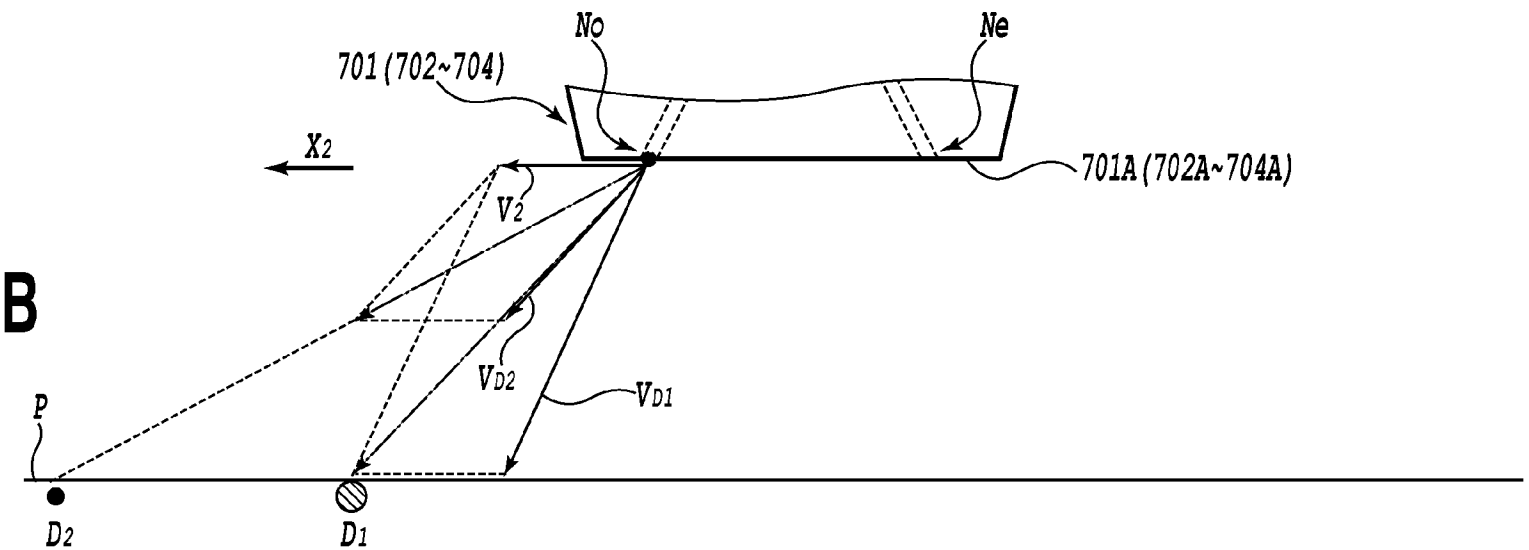
FIG. 5B is an explanatory view showing a positional relationship between a main dot and a satellite, which are formed in printing scanning in an opposite direction in the second embodiment of the present invention.

FIGS. 5A and 5B are explanatory views showing a positional relationship between a main dot D1 and a satellite D2 and a positional relationship between a main dot D'1 and a satellite D'2, respectively, as in the case of FIGS. 4A and 4B. A main droplet and a small droplet, which are ejected from an even nozzle Ne, form a main dot D'1 and a satellite D'2, respectively. Moreover, a main droplet and a small droplet, which are ejected from an odd nozzle No, form a main dot D1 and a satellite D2, respectively. FIG. 5A is the explanatory view showing the case of printing scanning in a forward direction X1, and FIG. 5B is the explanatory view showing the case of printing scanning in an opposite direction X2.

In this embodiment, in the case of the printing scanning in the forward direction X1 as shown in FIG. 5A, only the even nozzle Ne is used without using the odd nozzle No contrary to the case of the first embodiment described above. Specifically, the printing scanning is performed in the forward direction X1 by using only the even nozzle Ne having a large distance between the main dot and the satellite without using the odd nozzle No having a small distance between the main dot and the satellite.

On the other hand, in the case of the printing scanning in the opposite direction X2 as shown in FIG. 5B, in this embodiment, only the odd nozzle No is used without using the even nozzle Ne contrary to the case of the first embodiment described above. Specifically, the printing scanning is performed in the opposite direction X2 by using only the odd nozzle No having a large distance between the main dot and the satellite without using the even nozzle Ne having a small distance between the main dot and the satellite.

As described above, the even nozzle Ne is used in the case of the printing scanning in the forward direction X1, and the odd nozzle No is used in the case of the printing scanning in the opposite direction X2. Thus, in the printing scanning both in the forward direction X1 and in the opposite direction X2, the main droplets and the small droplets can be allowed to land apart from each other by approximately the same distance. Accordingly, the positional relationships between the main dots and the satellites can be set the same. As a result, the positional relationships between the main dots and the satellites can be made consistent. Thus, a good image can be printed.

Note, however, that it is preferable to implement this embodiment only when the number of passes of the multi-pass printing mode is an even number (even number of times of scanning). For example, in a 4-pass printing mode, printing scanning is performed in the forward direction for a first pass, in the opposite direction for a second pass, in the forward direction for a third pass, and in the opposite direction for a fourth pass. Thus, in two times of the printing scanning for the first and third passes, the satellites are formed so as to be shifted in the forward direction from the main dots. Moreover, in two times of the printing scanning for the second and fourth passes, the satellites are formed so as to be shifted in the opposite direction from the main dots. As a result, the satellites are formed so as to be evenly distributed relative to the main dots. Thus, a good image can be printed.

If this embodiment is implemented when the number of passes of the multi-pass printing mode is an odd number (odd number of times of scanning), an uneven image may be printed. For example, assumed is the case where, in a 3-pass printing mode, printing scanning is performed in the forward direction for a first pass, in the opposite direction for a second pass, and in the forward direction for a third pass. In this case, in two times of the printing scanning for the first and third passes, the satellites are formed so as to be shifted in the forward direction from the main dots. Moreover, in one time of the printing scanning for the second pass, the satellite is formed so as to be shifted in the opposite direction from the main dot. Therefore, the satellites cannot be formed so as to be evenly distributed relative to the main dots. Thus, an uneven image may be printed.

Therefore, in the case where a plurality of printing modes are provided and the number of passes for multi-pass printing is set in each of the printing modes, it is preferable that patterns of using the odd nozzle No and the even nozzle Ne are switched according to the number of passes determined by the printing mode to be selected by a user. Specifically, if the number of passes in the multi-pass printing mode is an even number, only the even nozzles Ne are used in the printing scanning in the forward direction X1 and only the odd nozzles No are used in the printing scanning in the opposite direction X2. On the other hand, if the number of passes in the multi-pass printing mode is an odd number, both of the odd nozzles No and the even nozzles Ne are used in the printing scanning in the forward direction X1 and in the opposite direction X2. Thus, image quality can be prevented from being degraded by printing of an uneven image in printing scanning for odd passes.

(Other Embodiments)

In the embodiments described above, the description was given of the case where the ink ejection direction of the even nozzle Ne is tilted toward the forward direction X1 and the ink ejection direction of the odd nozzle No is tilted toward the opposite direction X2. If the tilt directions thereof are reversed, the nozzles to be used for the printing scanning in the forward direction X1 and in the opposite direction X2 are opposite to those used in the embodiments described above. To be more specific, in the first embodiment described above, the odd nozzles No are used in the printing scanning in the forward direction X1 and the even nozzles Ne are used in the printing scanning in the opposite direction X2. However, if the ink ejection directions of the nozzles No and Ne are opposite to those in the embodiment described above, the even nozzles Ne are used in the printing scanning in the forward direction X1 and the odd nozzles No are used in the printing scanning in the opposite direction X2.

In the embodiments described above, the patterns of using the odd nozzles No and the even nozzles Ne are set according to the directions of the printing scanning regardless of the number of main droplets landing on a predetermined pixel region. However, the patterns of using the nozzles No and Ne may be set according to the directions of the printing scanning, as in the case of the embodiments described above, only when the number of ejections of the main droplets (the number of the main droplets landing) on the predetermined pixel region is not more than a predetermined number. When the number of ejections of the main droplets exceeds the predetermined number, the predetermined pixel region is filled with main dots. Accordingly, an influence of an area factor of satellites is reduced. Thus, as in the case of the conventional example shown in FIGS. 7A and 7B, the nozzles No and Ne may be used in the printing scanning both in the forward direction and in the opposite direction. The number of ejections of the main droplets on the predetermined pixel region can be determined based on printing data corresponding to each unit pixel region.

Moreover, the embodiments described above are based on the premise that the ink ejection directions of all the odd nozzles No on the odd nozzle array Lo are tilted toward the same direction and the ink ejection directions of all the even nozzles Ne on the even nozzle array Le are tilted toward the same direction. However, the present invention can also be applied to the case where the odd nozzles No eject ink in different directions while the even nozzles Ne also eject ink in different directions. In such a case, the ink ejection directions of the nozzles on the odd nozzle array Lo and on the even nozzle array Le are determined according to the largest number of nozzles having the ink ejection directions aligned in the same direction. For example, if the largest number of nozzles on the even nozzle array Le are the nozzles (even nozzles Ne) having the ink ejection directions tilted toward the forward direction X1, the ink ejection directions of the even nozzles Ne on the even nozzle array Le are determined to be tilted toward the forward direction X1 as in the case of the embodiments described above. In this case, in the second embodiment described above, the even nozzles Ne may be used in the printing scanning in the forward direction X1.

Moreover, the present invention can be applied to the case where the odd nozzle No and the even nozzle Ne have different ink ejection amounts (corresponding to sizes of ink droplets).

In either case, the present invention may be applied to any other cases as long as the odd nozzle No and the even nozzle Ne are used separately in each time of printing scanning.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-251537, filed Sep. 27, 2007, which is hereby incorporated by reference herein in its entirety.

What is claimed is:

1. An ink jet printing apparatus which prints an image by causing a printing head to scan a printing medium in a first direction and in a second direction opposite to the first direction, the printing head having a plurality of nozzles capable of ejecting ink of the same color, the plurality of nozzles being arranged in a first nozzle array extending in a direction intersecting the first and second directions and arranged in a second nozzle array extending in parallel with the first nozzle array, the ink jet printing apparatus comprising:

a controller which allows, when printing in a predetermined region on the printing medium is performed by scanning the printing head an even number of times, the ink to be ejected from nozzles in one of the first nozzle array and the second nozzle array in scanning in the first direction and also allows the ink to be ejected from nozzles in the other one of the first nozzle array and the second nozzle array in scanning in the second direction, and allows, when printing in a predetermined region on the printing medium is performed by scanning the printing head an odd number of times, the ink to be ejected from the nozzles in both of the first and second nozzle arrays in the scanning in the first direction and the second direction.

2. The ink jet printing apparatus according to claim 1, wherein an ink ejection direction of the nozzles in the first nozzle array and an ink ejection direction of the nozzles in the second nozzle array are different from each other in the first direction or in the second direction, and wherein the ink ejected from each of the nozzles in the first and second nozzle arrays includes a main droplet that forms a main dot on the printing medium and a small droplet that forms a satellite on the printing medium.

3. The ink jet printing apparatus according to claim 2, wherein a positional relationship between the main dot and the satellite, which are formed by the nozzles in the first nozzle array, differs between scanning in the first direction and scanning in the second direction, and wherein a positional relationship between the main dot and the satellite, which are formed by the nozzles in the second nozzle array, differs between scanning in the first direction and scanning in the second direction.

4. The ink jet printing apparatus according to claim 3, wherein the controller allows, when printing in a predetermined region on the printing medium is performed by scanning the printing head an even number of times, the ink to be ejected from the nozzles in the first nozzle array or from the nozzles in the second nozzle array according to the scanning direction so as to approximate the positional relationship between the main dot and the satellite, which are formed by the nozzles in the first nozzle array, and the positional relationship between the main dot and the satellite, which are formed by the nozzles in the second nozzle array.

5. The ink jet printing apparatus according to claim 3, wherein the positional relationship between the main dot and the satellite includes a space between the main dot and the satellite in the first direction or the second direction.

6. The ink jet printing apparatus according to claim 1, wherein, when printing in a predetermined region on the printing medium is performed by scanning the printing head an even number of times, and when the number of ink ejections onto a predetermined region on the printing medium exceeds a predetermined number, the controller allows the ink to be ejected in the predetermined region from the nozzles in both of the first and second nozzle arrays in the scanning in the first direction and the second direction.

7. The ink jet printing apparatus according to claim 1, wherein the nozzles in the first nozzle array and the nozzles in the second nozzle array are arranged alternately at the same pitches in the nozzle arrangement direction.

8. An ink jet printing method for printing an image by causing a printing head to scan a printing medium in a first direction and in a second direction opposite to the first direction, the printing head having a plurality of nozzles capable of ejecting ink of the same color, the plurality of nozzles being arranged in a first nozzle array extending in a direction intersecting the first and second directions and arranged in a second nozzle array extending in parallel with the first nozzle array, the ink jet printing method comprising the steps of:

when printing in a predetermined region on the printing medium is performed by scanning the printing head an even number of times, ejecting ink from nozzles in one of the first nozzle array and the second nozzle array in scanning in the first direction and ejecting the ink from nozzles in the other one of the first nozzle array and the second nozzle array in scanning in the second direction; and when printing in a predetermined region on the printing medium is performed by scanning the printing head an odd number of times, ejecting ink from the nozzles in both of the first and second nozzle arrays in the scanning in the first direction and the second direction.

* * * * *